US007281648B2

(12) United States Patent
Lowry

(10) Patent No.: US 7,281,648 B2
(45) Date of Patent: Oct. 16, 2007

(54) TRAY WITH MEANS FOR HOLDING A VERTICAL POST

(75) Inventor: James W. Lowry, Franklin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 331 days.

(21) Appl. No.: 10/904,636

(22) Filed: Nov. 19, 2004

(65) Prior Publication Data

US 2006/0108408 A1 May 25, 2006

(51) Int. Cl.
*B65D 5/42* (2006.01)
*A47F 3/14* (2006.01)
*B65D 21/00* (2006.01)

(52) U.S. Cl. ..... 229/199; 206/511; 206/512; 211/133.1; 229/918

(58) Field of Classification Search ..... 229/199, 229/918, 919; 206/511, 512, 586
See application file for complete search history.

(56) References Cited

U.S. PATENT DOCUMENTS 2,934,250 A * 4/1960 Stotz ..... 229/918
4,236,664 A * 12/1980 Hartelmuller ..... 229/918
4,579,233 A * 4/1986 Hepp ..... 211/126.12
4,676,429 A 6/1987 Crowe et al.
5,251,753 A * 10/1993 Pigott et al. ..... 206/586
5,522,539 A * 6/1996 Bazany ..... 229/199
5,544,806 A * 8/1996 Anderson et al. ..... 206/586
6,131,805 A 10/2000 Gasior
6,227,442 B1 * 5/2001 Evans, Jr. ..... 229/199
6,675,970 B1 * 1/2004 Nemoto ..... 229/918

FOREIGN PATENT DOCUMENTS

JP 9328125 12/1997

* cited by examiner

*Primary Examiner*—Gary E Elkins
(74) *Attorney, Agent, or Firm*—Clausen Miller, P.C.

(57) ABSTRACT

An improved tray or other packaging article having hinged tab portions for securing a vertical support post is provided. The hinged tab portions capture the vertically oriented post and hold it in place for easier assembly of a larger packaging unit.

4 Claims, 2 Drawing Sheets

TRAY WITH MEANS FOR HOLDING A VERTICAL POST

FIELD OF THE INVENTION

This patent relates to the packaging arts. More particularly, this invention relates to a tray and post packaging system in which the tray includes means for capturing and holding the posts in place to make easier assembly of the overall packaging system.

DESCRIPTION OF THE RELATED ART

Tubular paperboard posts are commonly used to cushion and protect packaged products such as large household appliances. The posts are made from paperboard wound into a tube and formed into a desirable shape, often one having an L-shaped cross-section so that the post can fit against a vertical edge of the product. Where the product is packaged inside a boxlike corrugated container, the posts are fitted against the vertical edges of the product and held in place between the product and the inner corners of the container. Additional posts having a generally I-shaped cross-section may be secured between the flat sides of the product and the container walls. In addition to protecting the product from side impact forces, the posts provide axial compression strength to enable stacking of packaged products (units).

Where the product is packaged in an open sided container, the container typically includes a top cap and base, and at their top and bottom ends each post is secured between the product and the top cap or base. Transparent film stretched around the posts helps unitize the package and protects the product from dust and dirt while giving a clear view of the product.

In the packaging of small items such as cylindrical snack food containers often it is not possible to secure the support posts between a vertical edge of the product and the walls of the container in which the products are shipped. In these situations an alternate means for securing the support posts is needed.

Thus it is an object of the present invention to provide a packaging system for relatively small items.

A further object of the invention is to provide a tray on which a relatively small item can rest and which includes means for holding vertical support posts in place.

Another object of the invention is to provide a tray for use with Sonoco Product Company's proprietary SONOPOP™ packaging system for shipping and displaying palletized products in a retail environment.

Further and additional objects will appear from the description, accompanying drawings, and appended claims.

SUMMARY

The present invention is an improved packaging article having means for capturing a vertical support post and holding it in place. The packaging article comprises a bottom panel and at least one side panel foldably connected to the bottom panel along a fold line. The means for capturing a vertical support post comprises a pair of tab portions die cut from a side panel and the bottom panel. The tab portions comprise a horizontal portion extending inward from the side panel and terminating at an intermediate fold line and a substantially vertical portion extending downward from the intermediate fold line and terminating at the bottom panel. The tab portions are configured to capture and hold in place a vertical support post between the tab portions.

The tab portions may be located near a corner of the packaging article and oriented perpendicularly to each other in order to capture and hold a corner post. Alternatively, the tab portions may be located along a side of the packaging article intermediate two corners and oriented parallel to each other in order to capture and hold a side post.

THE DRAWINGS

DETAILED DESCRIPTION OF THE INVENTION

Figure 1:
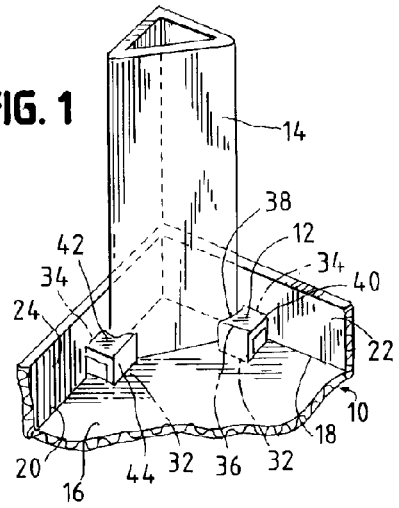
FIG. 1 is a perspective partial view of a tray according to the present invention having means for capturing and holding a corner post.

The invention is a tray or other packaging article having means for securing a vertical support post. FIG. 1 is a perspective view of a preferred embodiment of the present invention, a tray 10 having hinged tab portions 12. The hinged tab portions 12 capture and hold in place a vertical support post 14 (in this case, a corner post). The tray 10 and post 14 may be part of a larger packaging unit as described in more detail below. By holding the posts 14 upright, the tab portions 12 make assembly of the overall packaging unit easier.

Figure 2:
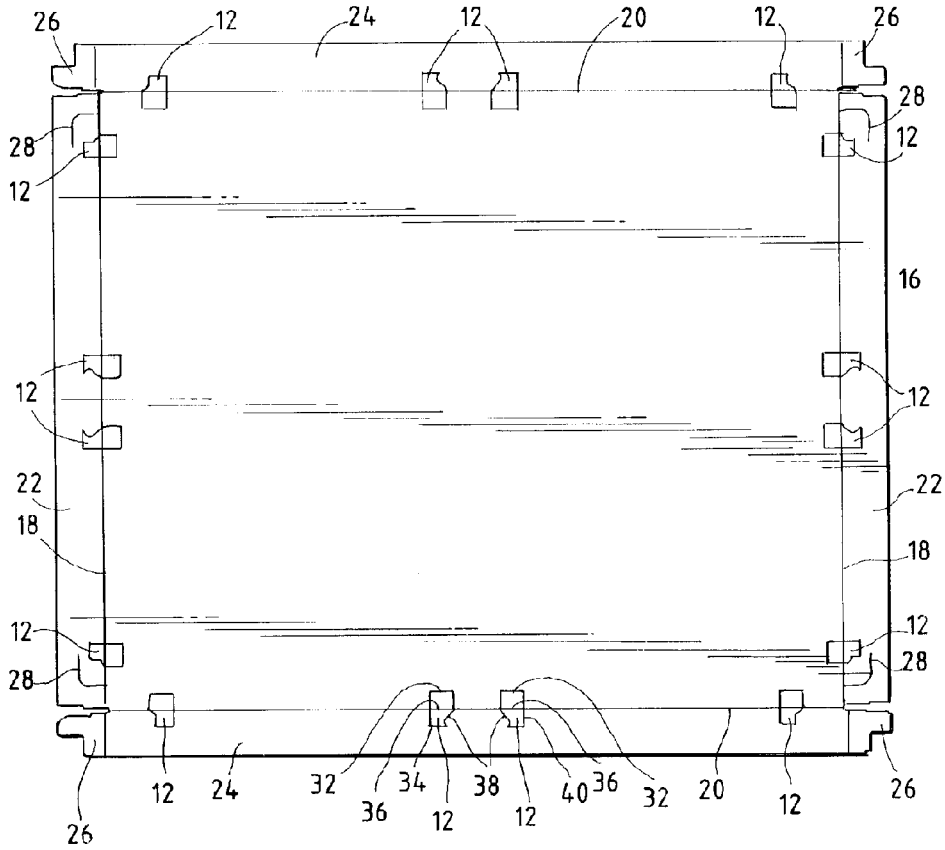
FIG. 2 is a top plan view of a blank used to form the tray of FIG. 1.

As shown in FIG. 2, the tray 10 is made from a blank 50 of corrugated board or other suitable material, the blank 50 comprising a bottom panel 16 defined by two sets of opposing fold lines 18, 20. Opposing side panels 22 are foldably connected to the bottom panel 16 along fold lines 18. Opposing side panels 24 are foldably connected to the bottom panel 16 along fold lines 20.

Connector tabs 26 are foldably attached to either end of the side panels 24. Each side panel 22 includes L-shaped slots 28 at either end for receiving the connector tabs 26. When the side panels 22, 24 are folded perpendicularly to the bottom panel 16 toward the interior side of the bottom panel 16, the connector tabs 26 fit within the slots 28 to hold the side panels 22, 24 together. Of course, other tab and slot configurations and other means of joining the tray sides are contemplated, including but not limited to adhesive and tape, and may be used without departing from the scope of the invention as described and claimed herein.

The vertical support posts 14 may be conventional paperboard posts of the kind marketed by Sonoco Products Company of Hartsville, S.C., including those described in one or more of the following U.S. Pat. Nos. 5,267,651; 6,247,596; 6,513,662; 6,520,336, all incorporated herein by reference. The posts may also be formed from metal, plastic or any suitable material.

Still referring to FIG. 2, multiple tab portions 12 are die cut from the side panels 22, 24 and the bottom panel 16. Each tab portion 12 is connected to the bottom panel 16 by a first fold line 32 and to a side panel 22, 24 by a second fold line 34. Each tab portion 12 has a fold line 36 intermediate the first and second fold lines 32, 34 that acts like a living hinge to enable the tab portion 12 to bend.

Each tab portion 12 is further defined by inner and outer die cut lines 38, 40 extending from the first fold line 32 on the bottom panel 16 to second fold line 34 on a side panel 22, 24. The inner die cut line 38, located on the side of the tab portion 12 facing the vertical support post 14, may be contoured to better accommodate the shape of the post 14 (FIG. 1). The outer die cut line 40, located away from the vertical support post 14, runs substantially perpendicular to the first and second fold lines 32, 34.

To assemble the tray 10, the side panels 22, 24 are folded so that they extend upward at a ninety degree angle from the bottom panel 16. The connecting tabs 26 are inserted into the slots 28 in the side panels 22 to form the corners of the tray 10. The tab portions 12 are pressed inward to form buttress-like structures having a first portion 42 that extends substantially horizontally inward from the side panels 22, 24 and terminates at the intermediate fold line 36 and a second portion 44 that extends substantially vertically downward from the intermediate fold line 36 and terminates at the first fold line 32 and bottom panel 16 (FIG. 1).

Figure 3:
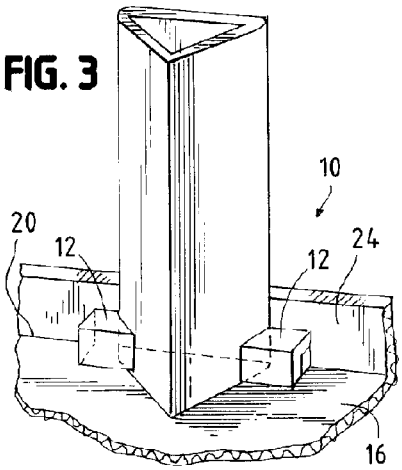
FIG. 3 is a perspective partial view of a tray according to the present invention having means for capturing and holding a side post.

As shown in FIG. 1 a pair of tab portions 12 near each corner and oriented perpendicular to each other are configured to capture a corner post 14 and hold the corner post 14 in vertical alignment. As shown in FIG. 3 other tab portions 12 located along a side 24 of the bottom panel 16 intermediate the corners and oriented parallel to each other may be used to secure side support posts 14 at those locations.

Figure 4:
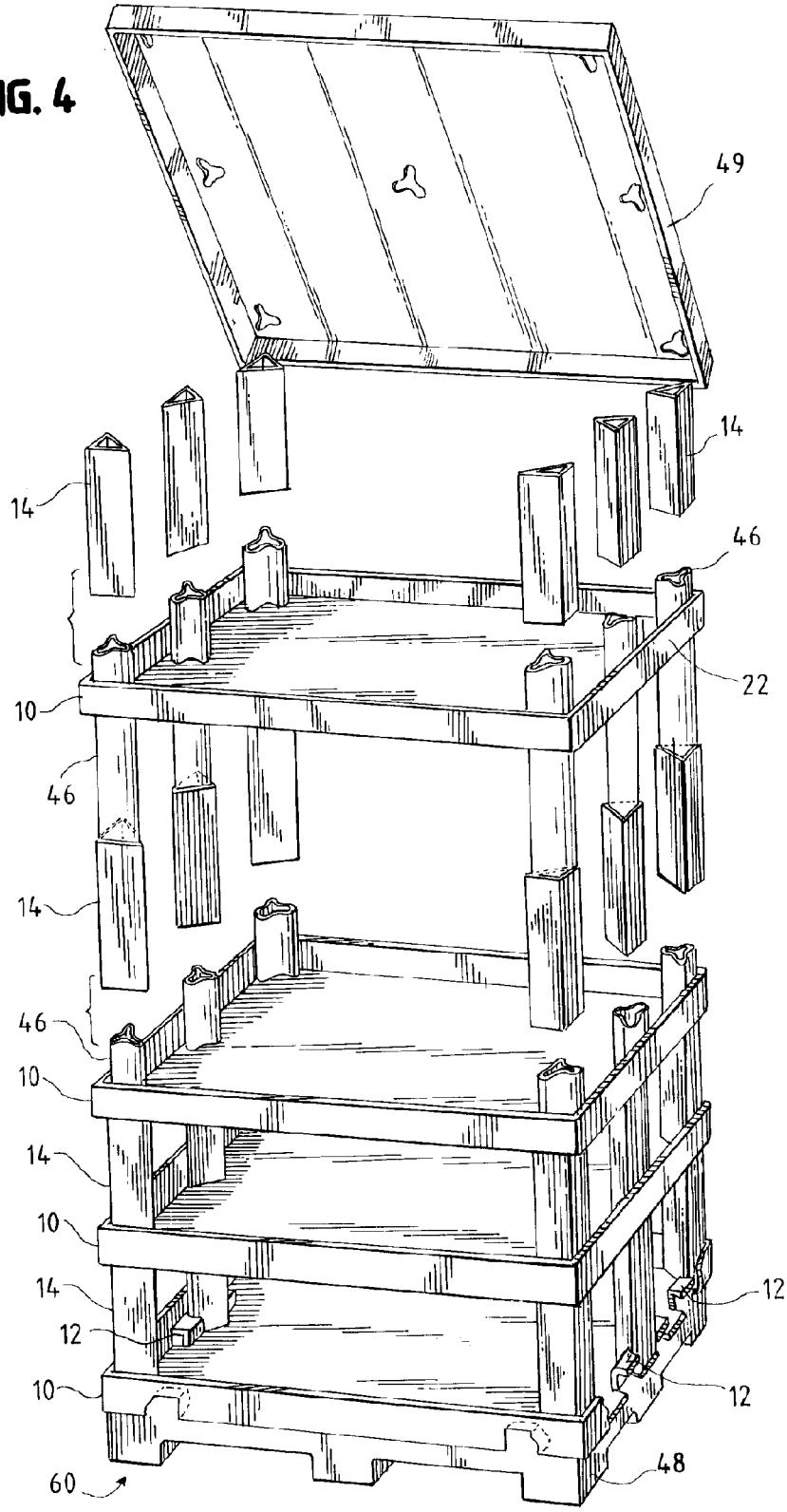
FIG. 4 is a perspective view of a packaging and display system incorporating the tray of the present invention.

As shown in FIG. 4, multiple trays 10 may be stacked on top of each other to form a larger structure 60 for shipping and displaying products. For example, the invention may be used with Sonoco Product Company's proprietary SONOPOP™ post-in-post packaging system for shipping and displaying palletized products. The SONOPOP™ system is described in co-pending U.S. patent application Ser. No. 10/605,814, incorporated herein by reference. As shown in FIG. 4, the SONOPOP™ system comprises vertically arranged trays 10 for holding products (not shown), outer support posts 14 located over openings in each tray 10 so that their hollow interiors communicate with the openings, and inner guide posts 46 inserted inside the outer support posts 14 and through the tray openings to lock the trays 10 together. The bottom tray rests on a standard pallet 48 and a top cap 49 is placed over the topmost support posts 14. Significantly, the bottom tray 10 is made according to the present invention so that the bottommost set of outer support posts 14 are held securely in place prior to the inserting of the bottom set of inner guide posts 46, thus making assembly of the SONOPOP™ system easier.

Other modifications and alternative embodiments of the invention are contemplated which do not depart from the scope of the invention as defined by the foregoing teachings and appended claims. It is intended that the claims cover all such modifications that fall within their scope.

What is claimed is:

1. A packaging system comprising:

a tray comprising a bottom panel, side panels foldably connected to the bottom panel along fold lines, and at least one pair of tab portions, each tab portion being die cut from one of the side panels and the bottom panel and comprising a substantially horizontal portion extending inward from the one of the side panels and terminating at an intermediate fold line and a substantially vertical portion extending downward from the intermediate fold line and terminating at the bottom panel, each tab portion being connected to the bottom panel by a first fold line and to the one of the side panels by a second fold line, each tab portion being further defined by inner and outer die cut lines extending from the first fold line on the bottom panel to the second fold line on the one of the side panels; and a vertical support post secured between the pair of tab portions.

2. The packaging system of claim 1 wherein the inner die cut line is contoured to mate with a non-flat surface of the vertical support post.

3. The packaging system of claim 1 wherein the tab portions are located near a corner of the tray and are oriented perpendicular to each other.

4. The packaging system of claim 1 wherein the tab portions are located along a side of the bottom panel intermediate two tray corners and are oriented parallel to each other.

* * * * *